US009889644B2

(12) United States Patent
Hachmann

(10) Patent No.: US 9,889,644 B2
(45) Date of Patent: Feb. 13, 2018

(54) METHOD FOR INKJET PRINTING

(71) Applicant: HEIDELBERGER DRUCKMASCHINEN AG, Heidelberg (DE)

(72) Inventor: Peter Hachmann, Weinheim-Hohensachsen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 15/465,800

(22) Filed: Mar. 22, 2017

(65) Prior Publication Data

US 2017/0274646 A1 Sep. 28, 2017

(30) Foreign Application Priority Data

Mar. 23, 2016 (DE) ..... 10 2016 204 790

(51) Int. Cl.
*B41J 2/045* (2006.01)

(52) U.S. Cl.
CPC ..... *B41J 2/04556* (2013.01); *B41J 2/04585* (2013.01)

(58) Field of Classification Search
CPC .... B41J 2/04556; B41J 2/04585; B41J 2/072; B41J 2/085; B41J 2/365
See application file for complete search history.

(56) References Cited

U.S. PATENT DOCUMENTS

| | | | | |
|---|---|---|---|---|
| 5,592,202 | A | 1/1997 | Erickson | |
| 7,066,567 | B2 * | 6/2006 | Nishino | B41J 2/04503 347/17 |
| 9,365,029 | B2 | 6/2016 | Maul et al. | |
| 2002/0171697 | A1 | 11/2002 | Gargir et al. | |
| 2004/0084837 | A1 | 5/2004 | Gerstenberger et al. | |

FOREIGN PATENT DOCUMENTS

| | | | |
|---|---|---|---|
| DE | 10346782 | A1 | 5/2004 |
| DE | 102014002907 | B3 | 3/2015 |
| EP | 1415804 | A1 | 5/2004 |
| JP | 2004148828 | A | 5/2004 |

* cited by examiner

*Primary Examiner* — Thinh H Nguyen
(74) *Attorney, Agent, or Firm* — Laurence A. Greenberg; Werner H. Stemer; Ralph E. Locher

(57) ABSTRACT

A method for printing on sheets in an inkjet process using nozzles includes transporting the sheets on a drum. When the nozzles are actuated by a computer, banding defects are compensated for and the computer factors in or takes into consideration thermal properties of the drum as it actuates the nozzles.

10 Claims, 5 Drawing Sheets

METHOD FOR INKJET PRINTING

CROSS-REFERENCE TO RELATED APPLICATION

This application claims the priority, under 35 U.S.C. § 119, of German Application DE 10 2016 204 790.6, filed Mar. 23, 2016; the prior application is herewith incorporated by reference in its entirety.

BACKGROUND OF THE INVENTION

Field of the Invention

The present invention relates to a method for printing onto sheets in an inkjet process using nozzles.

Printed images that have been created in an inkjet process may have visible defects that are known as banding defects. Such banding defects are visible as stripes or lines extending in the direction of sheet transport. A reason for such banding defects is nozzle malfunctioning.

U.S. Patent Application Publication US 2002/0171697 A1 discloses a method for banding defect compensation in inkjet printing machines.

SUMMARY OF THE INVENTION

It is accordingly an object of the invention to provide a method for inkjet printing on sheets in an inkjet process using nozzles, which overcomes the hereinafore-mentioned disadvantages of the heretofore-known methods of this general type.

With the foregoing and other objects in view there is provided, in accordance with the invention, a method for printing on sheets in an inkjet process using nozzles. The method comprises transporting the sheets on a drum, compensating for banding defects when the nozzles are actuated by using a computer, and factoring in or taking into consideration thermal properties of the drum when the computer actuates the nozzles.

An advantage of the method of the invention is that it allows format-adjustable drums having clamping grippers for securely holding the sheets to be used for transporting the sheets. In particular, a drum having clamping grippers and additional suction grooves for securing the sheets by vacuum may be used, as disclosed in German Patent Application DE 103 46 782 A1, corresponding to European Patent Application EP 1 415 804 A1, Japanese Patent Application JP 2004 148828 A and U.S. Patent Application US 2004/084837 A1). For this reason, the description of the drum referred to as the "second sheet transport drum 9" in the aforementioned documents is incorporated by reference herein.

In one further development, the thermal properties include local variations in thermal conductivity between the sheet-supporting contact surfaces of the drum and air-filled clearances located between the contact surfaces.

In another development, every sheet is transported on a first comb segment and a second comb segment, each one of the two comb segments having segment teeth forming the contact surfaces. A front section of a respective sheet rests on the first comb segment while a rear section of the same sheet simultaneously rests on the second comb segment.

In a further development, when a format-adjustment of the drum is made prior to the printing process, the segment teeth of a respective one of the comb segments are incompletely inserted into teeth gaps of the other of the comb segments, forming the clearances.

In an added development a first optical measurement is taken in the front section of the respective sheet and a second optical measurement is taken in the rear section of the same sheet or of a different sheet.

In an additional development, the nozzles print a first measurement field into the front section and a second measurement field into the rear section. In a case in which the two measurement fields are on one and the same sheet, the sheet is a test print sheet, and in the alternative case in which the first measurement field is on a different sheet than the second measuring field, both sheets are test print sheets. In other words: either the sheet including the front section and the rear section is a single test print sheet or the two different sheets including the front section and the rear section are two test print sheets.

In yet another development, the first optical measurement is taken in measurement locations on the (test print) sheet that correspond to the clearances and the second optical measurement is taken in measurement locations corresponding to segment teeth on the same (test print) sheet or on the other (test print) sheet.

In yet a further development, values for actuating the nozzles are calculated on the computer on the basis of the first optical measurement and the second optical measurement and the nozzles are actuated by the computer on the basis of these values.

In yet an added development, the calculation of the values for actuating the nozzles includes the calculation of an average value on the computer.

In a concomitant development, overcompensation and/or under compensation is avoided by factoring in or taking into consideration the thermal properties when the banding defects are compensated for.

Other features which are considered as characteristic for the invention are set forth in the appended claims.

Although the invention is illustrated and described herein as embodied in a method for inkjet printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
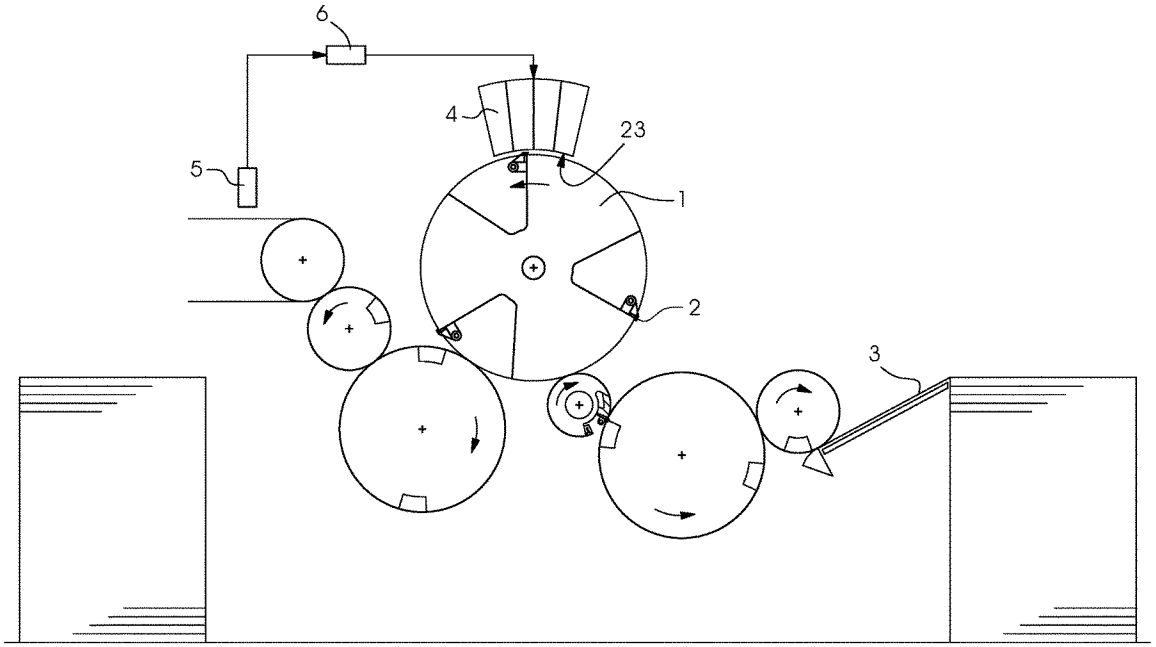
FIG. 1 is a diagrammatic, longitudinal-sectional view of a digital printing machine for inkjet printing.

Referring now to the figures of the drawings in detail and first, particularly, to FIG. 1 thereof, there is seen a printing machine having a drum 1 with grippers 2 for clamping sheets 3. The drum 1 moves the sheets 3 past a print head 4 for inkjet printing, the print head 4 having nozzles 23 and being oriented towards the drum 1 to print on the sheets 3. A measuring device 5 for taking optical measurements on the sheets 3 forwards measured results to an electronic computer 6 that actuates the nozzles 23 of the print head 4.

Figure 2:
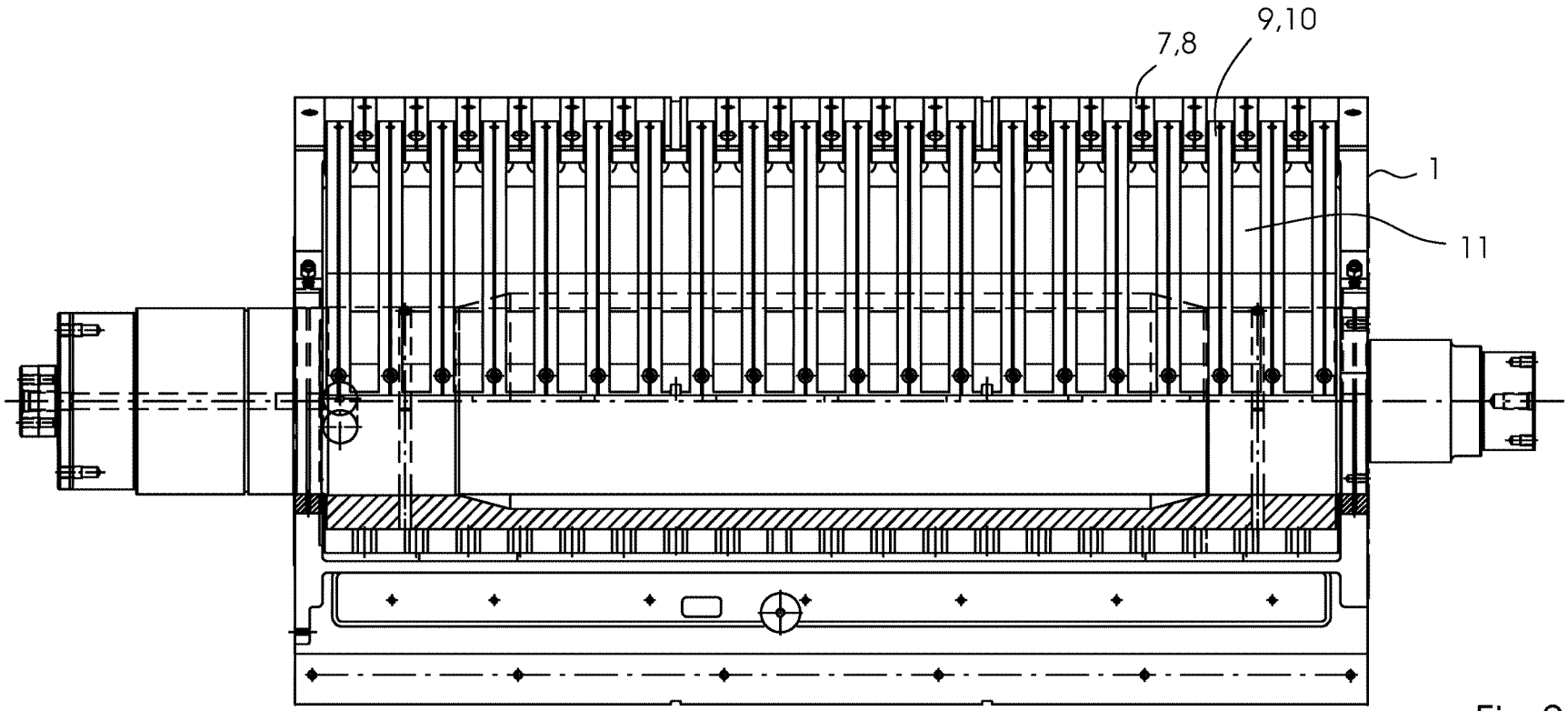
FIG. 2 is a longitudinal-sectional view of a sheet-transporting drum of the digital printing machine of FIG. 1.

FIG. 2 illustrates the drum 1 as a separate unit. The drum 1 includes a first comb segment 7 having segment teeth 8 and a second comb segment 9 having segment teeth 10. The comb segments 7, 8 are movable towards and away from each other to make sheet format adjustments. The segment teeth 8, 10 define clearances 11 having a size which depends on the adjusted format. The drum 1 corresponds to the sheet transport drum described in German Patent Application DE 103 46 782 A1, corresponding to European Patent Application EP 1 415 804 A1, Japanese Patent Application JP 2004 148828 A and U.S. Patent Application US 2004/084837 A1, which is hereby incorporated by reference herein.

The sheet 3, which rests on the comb segments 7, 9 as it is being transported by the drum 1, contacts the drum 1 in the regions of the segment teeth 8, 10 and does not contact the drum 1 in the regions of the clearances 11. Thus, in the regions of the segment teeth 8, 10, the thermal transfer between the drum 1 and the sheet 3 is different than in the regions of the clearances 11.

Figure 3:
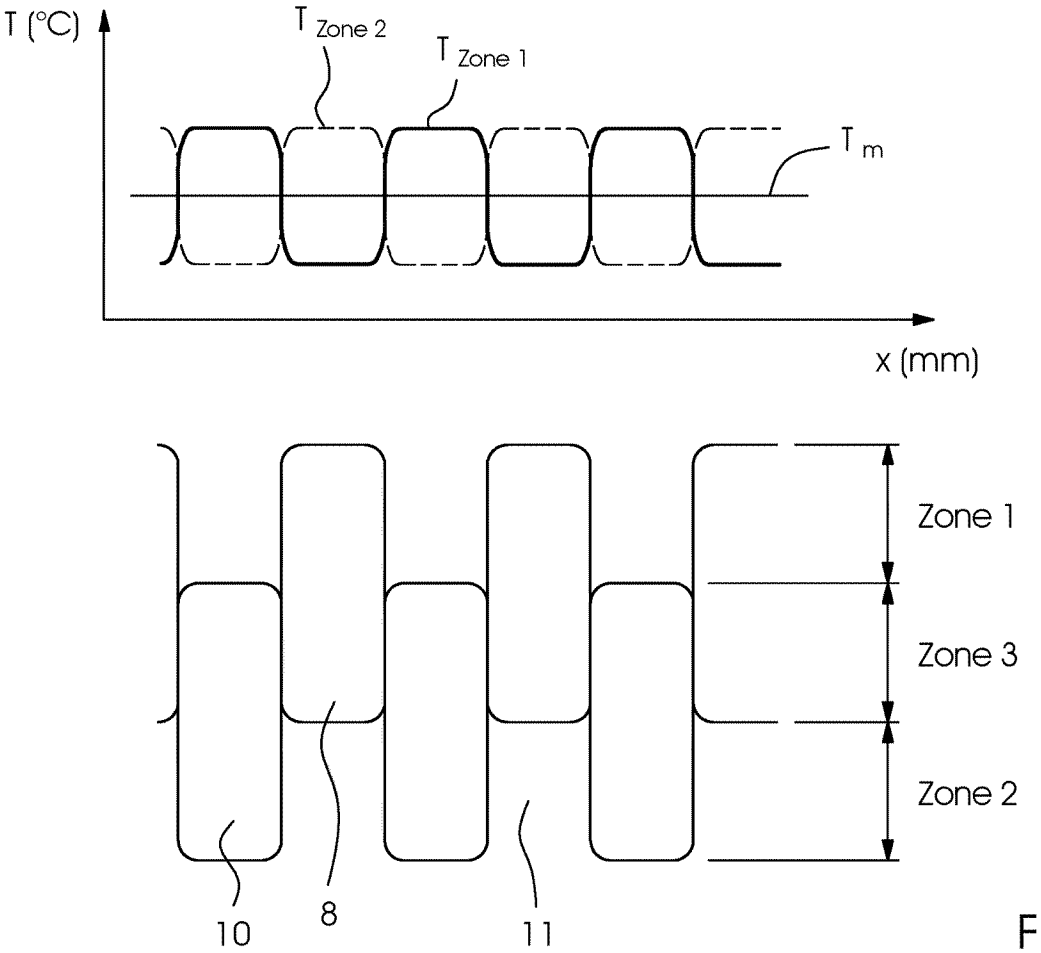
FIG. 3 is a diagram illustrating temperature profiles of the sheet-transporting drum of FIG. 2.

The diagram of FIG. 3 illustrates that the meshing of the comb segments 7, 9 results in three zones 1, 2, and 3. In a central zone 3, the segment teeth 8 of the first comb segment 7 and the segment teeth 10 of the second comb segment 9 overlap. In the zone 1, which is disposed in front of the zone 3 in the direction of rotation of the drum, the segment teeth 8 of the first comb segment 7 and the clearances 11 located in between alternate in a direction parallel to the axis of rotation of the drum. In the zone 2, which is behind the central zone 3, the segment teeth 10 of the second comb segment 9 alternate with the clearances 11 located in between. As viewed in the direction of rotation of the drum, the clearances 11 of the first comb segment 7 are flush with the segment teeth 10 of the second comb segment 9 and the clearances 11 of the second comb segment 9 are flush with the segment teeth 8 of the first comb segment 7. In the central zone 3, there are no clearances 11 and segment teeth 8 and segment teeth 10 alternate in a direction parallel to the axis of rotation of the drum.

In the diagram at the top of FIG. 3, the abscissa indicates the x coordinate, which is to be measured in a direction perpendicular to the direction of sheet transport, and the ordinate indicates the y coordinate which is the temperature of the sheet 3 resting on the comb segments 7, 9. The curve indicated by a continuous line represents the progression of the temperature in zone 1 and the dashed curve represents the progression of the temperature in zone 2. The temperature $T_{Zone1}$ has its maxima in the region of the clearances 11 of the first comb segment 7 and its minima in the region of the segment teeth 8. This becomes evident when comparing the diagram and the schematic representation shown underneath it. The temperature $T_{Zone2}$ has its maxima in the region of the clearances 11 of the second comb segment 9 and its minima in the region of the segment teeth 10. Accordingly, temperature profiles $T_{Zone1}$ and $T_{Zone2}$ are inverted relative to one another. For every measurement location x, an average temperature $T_m$ may be calculated. The average temperature $T_m$ is calculated as one half of the total of the temperatures $T_{Zone1}$ and $T_{Zone2}$: $T_m=0.5\times(T_{Zone1}+T_{Zone2})$. A first temperature difference between the temperature $T_{Zone1}$ in zone 1 and the average temperature $T_m$ is $\Delta T_1=T_{Zone1}-T_m$. A second temperature difference between the temperature $T_{Zone2}$ in zone 2 and the average temperature $T_m$ is $\Delta T_2=T_{Zone2}-T_m$. The following applies: $\Delta T_1+\Delta T_2=0$.

Figure 4:
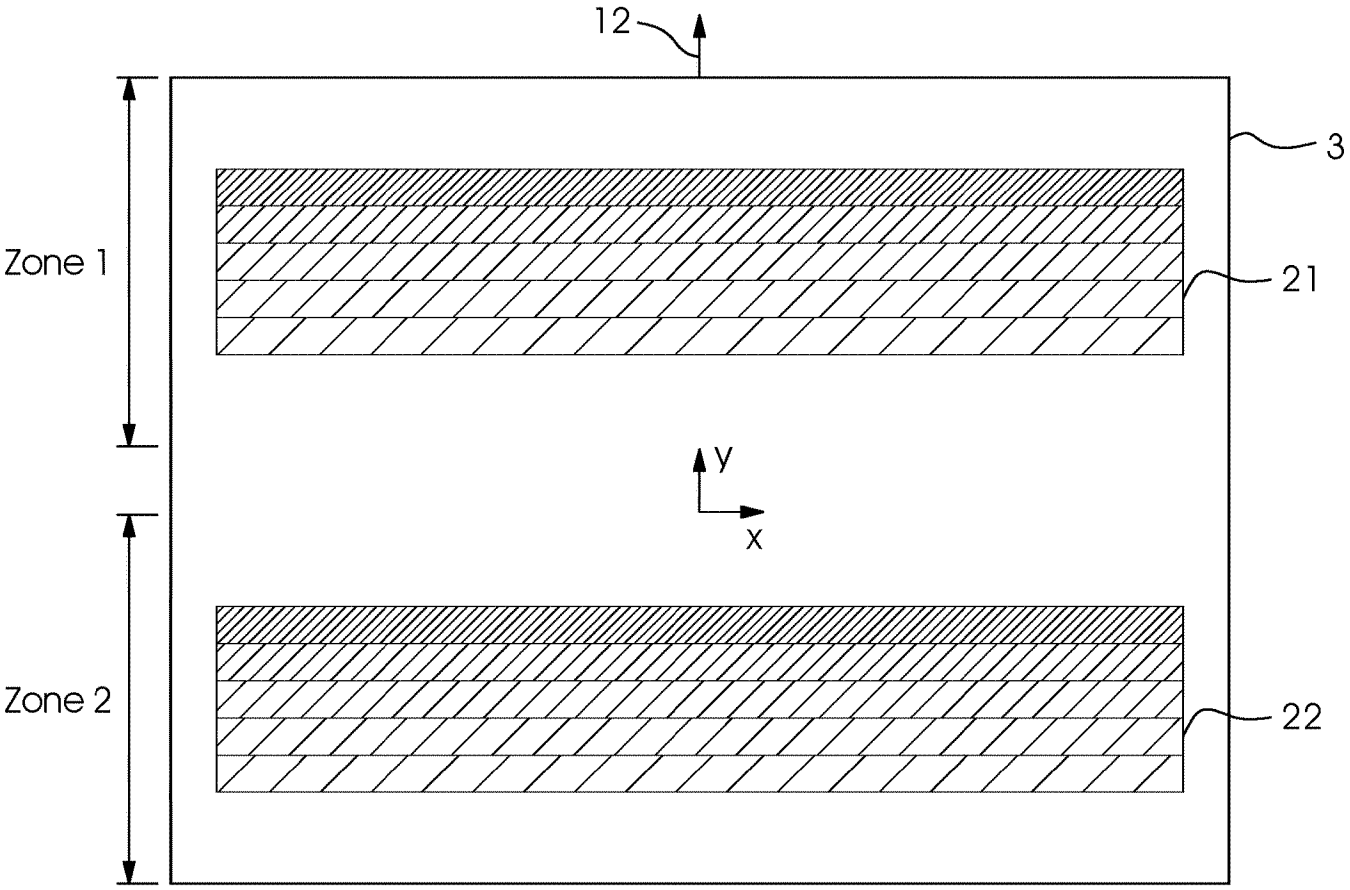
FIG. 4 is a plan view of a test print sheet printed in the digital printing machine of FIG. 1 and including measurement fields.

FIG. 4 illustrates a sheet 3 that has been printed on in the printing machine and is a test print. A first measurement field 21 is located in the leading sheet half as viewed in the direction of sheet transport 12 and a second measurement field 22 is located in the trailing sheet half. The first measurement field 21 is located in a sheet section that corresponds to zone 1 whereas the second measurement field 22 is located in a sheet section corresponding to zone 2 (see FIG. 3). Each one of the measurement fields 21, 22 extends over the entire width of the printed image. Every measurement field 21, 22 includes a number of strips that are parallel to one another and have different levels of optical density, color density, or area coverage. The print head 4 prints the measurement fields 21, 22 onto the sheet 3 in an inkjet process and the measuring device 5 takes measurements thereon. The measuring device 5 may be a camera that measures the optical color density in the measurement fields 21, 22.

In the illustrated test print sheet, the two measurement fields 21, 22 are on one and the same sheet 3. Alternatively, it would be possible to print only a first measurement field 21 onto a first test print sheet and a second measurement field 22 onto a second test print sheet. The digital print head might print the two test print sheets successively and the measuring device 5 might successively take measurements thereon.

Irrespective of whether one or two test print sheets are used, the goal is to detect so-called banding defects and to compensate them. Banding defects are visible stripes or lines in the printed image that are parallel to the direction of sheet transport 12 and result from ink drop volume fluctuations between the nozzles of the print head 4. For instance, the ink drop volume of one nozzle may deviate from the ink drop volume of another nozzle because the nozzle in question is partly blocked. The banding defects are then detected by the measuring device 5 and forwarded to the computer 6. Based on this information, the computer 6 calculates data for actuating the print head 4 in such a way as to compensate for the banding defects. For instance, the computer 6 may actuate the print head 4 in such a way as to make the partly blocked nozzle eject an increased number of ink drops to compensate for the reduced volume emitted per ink drop and to maintain the total emitted ink volume on the same level.

In the context of the present invention it has been found that a compensation for banding defects without factoring in or taking into consideration the temperature differences $\Delta T_1$ and $\Delta T_2$ would lead to undercompensation in the sheet section corresponding to zone 1 and to overcompensation in the sheet section corresponding to zone 2. $\Delta Lab_1$ and $\Delta Lab_2$ are understood to be color deviations measured in the Lab color space. Without factoring in or taking into consideration the temperature, the color deviation in the sheet section corresponding to zone 1 would be $\Delta Lab_1=0$ and the color deviation in the sheet section corresponding to zone 2 would be $\Delta Lab_2=a\times(\Delta T_2-\Delta T_1)=2a\times\Delta T_2$.

Figure 5:
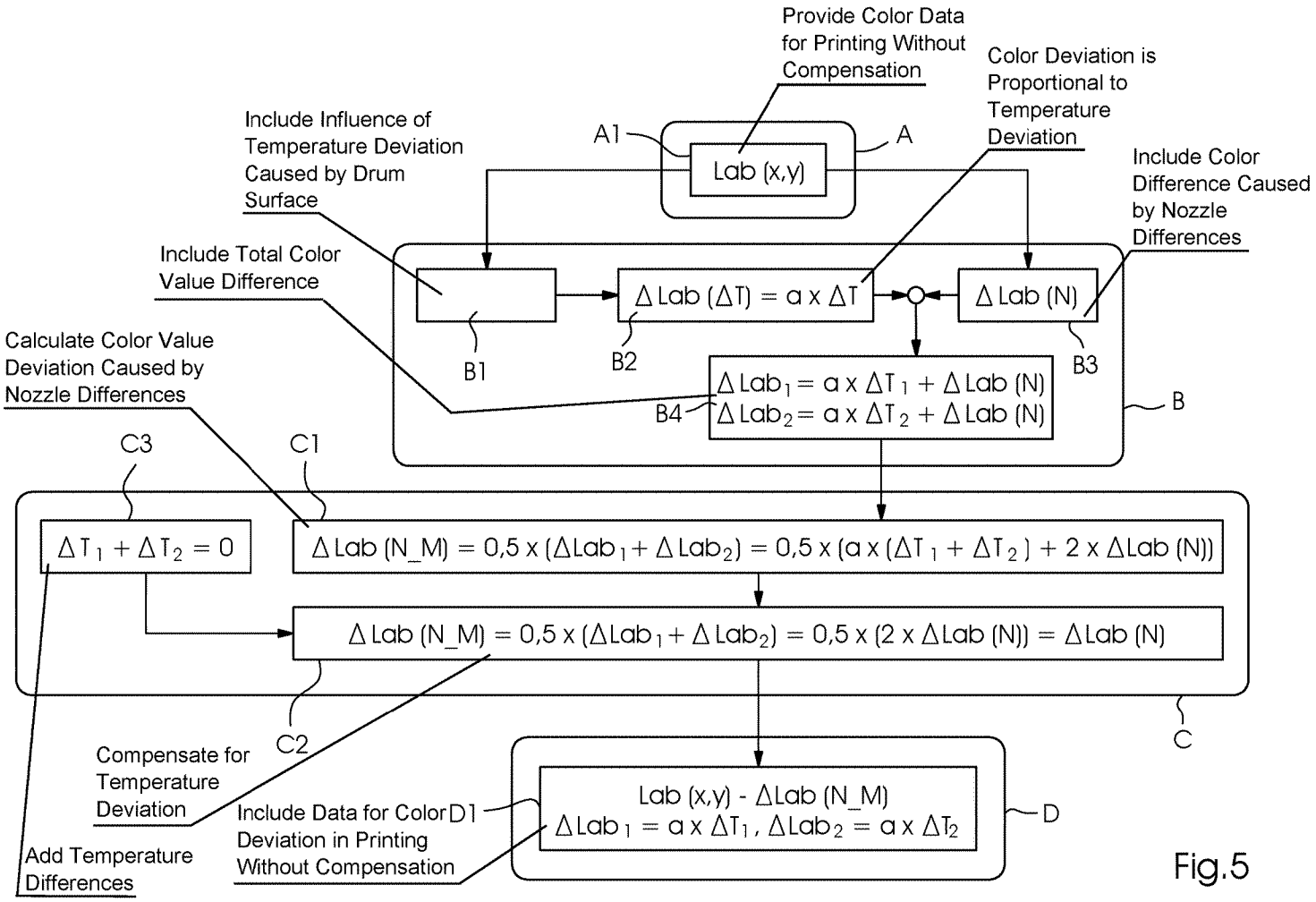
FIG. 5 is a program flow chart for a method for compensating for banding defects that takes the temperature profiles of FIG. 3 into consideration.

FIG. 5 illustrates a banding compensation method including temperature compensation. The method is subdivided into sections A to D, which include steps A1 to D1.

Section A describes the initial situation. In step A1, the color data for printing without compensation are provided: Lab(x,y).

Section B includes printing and measuring the color deviation in various measurement locations located in a row that is perpendicular to the direction of sheet transport 12 on a sheet 3. Step B1 includes the influence of the temperature deviation caused by the surface structure of the drum 1. In step B2, the color deviation is found to be proportional to the temperature deviation: $\Delta Lab(\Delta T)=a\times\Delta T$. The temperature deviation and the color deviation are linked by a proportionality factor a. Step B3 includes the color value difference caused by the differences between the nozzles of the print head 4. $\Delta Lab(N)$. Step B4 includes the total color value difference, which results from merging steps B2 and B3. $\Delta Lab_1=a\times\Delta T_1+\Delta Lab(N)$ applies to the measurement in the first measurement field 21. $\Delta Lab_2=a\times\Delta T_2+\Delta Lab(N)$ applies to the measurement in the second measurement field 22.

Section C includes a calculation of the deviation from nozzle to nozzle to compensate for the banding defect while compensating for temperature-related deviations. This calculation is made by the computer 6 based on the data provided by the measuring device 5. Step C1 includes a calculation of the color value deviation caused by differences from nozzle to nozzle: $\Delta Lab(N_M)=0.5\times(\Delta Lab_1+\Delta Lab_2)=0.5\times[a\times(\Delta T_1+\Delta T_2)+2\times\Delta Lab(N)]$. $\Delta Lab(N_M)$ is understood to be the deviation in the Lab color space measured (M=measured) for a specific nozzle (N=nozzle). In step C2, the temperature deviation is compensated for. As has been explained in the context of FIG. 3, it is to be assumed that the temperature difference $\Delta T_1$ in zone 1 is of the same absolute value as the temperature difference $\Delta T_2$ in zone 2 but of reversed sign: $\Delta T_1+\Delta T_2=0$. This is the content of step C3, which is factored-in in step C2: $\Delta Lab(N_M)=0.5\times(\Delta Lab_1+\Delta Lab_2)=0.5\times[2\times\Delta Lab(N)]=\Delta Lab(N)$.

Section D includes actuating the print head 4 using the values calculated by the computer 6 and printing by using the print head 4 while compensating for the banding defect. Step D1 includes the data for the color deviation in the printing process without compensation: $Lab(x, y)-\Delta Lab(N_M)$. The printing process with compensation then occurs with the following color deviation: $\Delta Lab_1=a\times\Delta T_1$ and $\Delta Lab_2=a\times\Delta T_2$. It can be seen that the temperature transition differences between the clearances 11 and the segment teeth 8, 9 no longer shift the color value differences upward or downward as would be the case without temperature compensation ($\Delta Lab_1=0$, $\Delta Lab_2=a\times(\Delta T_2-\Delta T_1)=2a\times\Delta T_2$).

The invention claimed is:

1. An inkjet printing method for printing on sheets using nozzles, the method comprising:

transporting the sheets on a drum;

using a computer to actuate the nozzles while compensated for banding defects; and taking thermal properties of the drum into consideration as the computer actuates the nozzles.

2. The method according to claim 1, wherein the thermal properties include local thermal conductivity differences between contacting surfaces of the drum for carrying the sheets and air-filled clearances located between the contact surfaces.

3. The method according to claim 2, which further comprises:

providing the drum with a first comb segment and a second comb segment;

providing the comb segments with segment teeth forming the contacting surfaces; and transporting every sheet on the first and second comb segments with a front section of a respective sheet resting on the first comb segment and a rear section of the same respective sheet resting on the second comb segment.

4. The method according to claim 3, which further comprises during a format adjustment made prior to a printing process on the drum, incompletely inserting the segment teeth of a respective one of the comb segments into teeth gaps of the other of the comb segments, forming the clearances.

5. The method according to claim 4, which further comprises taking a first optical measurement in the front section of a respective sheet and taking a second optical measurement in the rear section of the same respective sheet or of another sheet.

6. The method according to claim 5, which further comprises:

using the nozzles to print a first measurement field onto the front section and a second measuring field onto the rear section; and providing either the sheet including the front section and the rear section as a test print sheet or providing two different sheets including the front section and the rear section as test print sheets.

7. The method according to claim 5, which further comprises taking the first optical measurement in measurement locations on the sheet corresponding to the clearances and taking the second optical measurement in measurement locations corresponding to the segment teeth.

8. The method according to claim 5, which further comprises using the computer to calculate values for actuating the nozzles based on the first optical measurement and on the second optical measurement, and using the computer to actuate the nozzles based on the values.

9. The method according to claim 8, wherein the calculation of the values for actuating the nozzles includes a calculation of an average value by the computer.

10. The method according to claim 1, which further comprises avoiding at least one of overcompensation or under compensation when taking the thermal properties in the compensation for the banding defects into consideration.

* * * * *